US005207321A

United States Patent [19]

Jones

[11] Patent Number: 5,207,321

[45] Date of Patent: May 4, 1993

[54] PORTABLE STORAGE DEVICE

[76] Inventor: Errol Jones, 45 Carolbreen Sq., Scarborough, Canada, M1V 1J1

[21] Appl. No.: 864,689

[22] Filed: Apr. 7, 1992

[51] Int. Cl.[5] ..... B65D 69/00

[52] U.S. Cl. ..... 206/223; 206/561; 220/552; 220/553

[58] Field of Search ..... 206/223, 561, 216; 220/552, 553

[56] References Cited

U.S. PATENT DOCUMENTS 2,903,127 9/1959 Dorman ..... 220/552 X
2,919,169 12/1959 Jackson ..... 220/553 X
3,722,956 3/1973 Lee et al. ..... 220/553 X
3,751,845 8/1973 Van Leeuwen ..... 206/561 X
5,052,580 10/1991 Khoury ..... 220/552 X

*Primary Examiner*—William I. Price

[57] ABSTRACT

A portable storage device comprises a base having an upright forward wall, an upright panel supported on the base and a storage surface on the base between the forward wall and the panel. The forward wall is substantially shorter than the panel allowing access to the storage surface. The device further includes an elasticized support across the panel at a height elevated relative to the forward wall above the storage surface.

3 Claims, 2 Drawing Sheets

PORTABLE STORAGE DEVICE

FIELD OF THE INVENTION

The present invention relates to a portable storage device and is particularly useful for the storage of home cleaning products.

BACKGROUND OF THE INVENTION

Most home cleaning products when not in use, are kept in a relatively inaccessible location such as a cupboard or under a counter. They must be gathered individually and carried around to perform various different cleaning operations. After those cleaning operations have been completed, all the cleaning products must then be returned one by one to their storage location.

SUMMARY OF THE PRESENT INVENTION

The present invention provides a portable storage device particularly useful for the storage of household cleaning goods, although it can also be used with other types of articles to be stored.

More particularly, an article storage device of the present invention comprises a base having an upright forward wall, upright panel means supported on the base and a storage surface between the forward wall and the panel means. The forward wall is substantially shorter than the panel means allowing access to the storage surface. In order to provide for additional support for any articles on the storage surface an elasticized support extends across the panel means at a height elevated relative to the forward wall above the storage surface.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
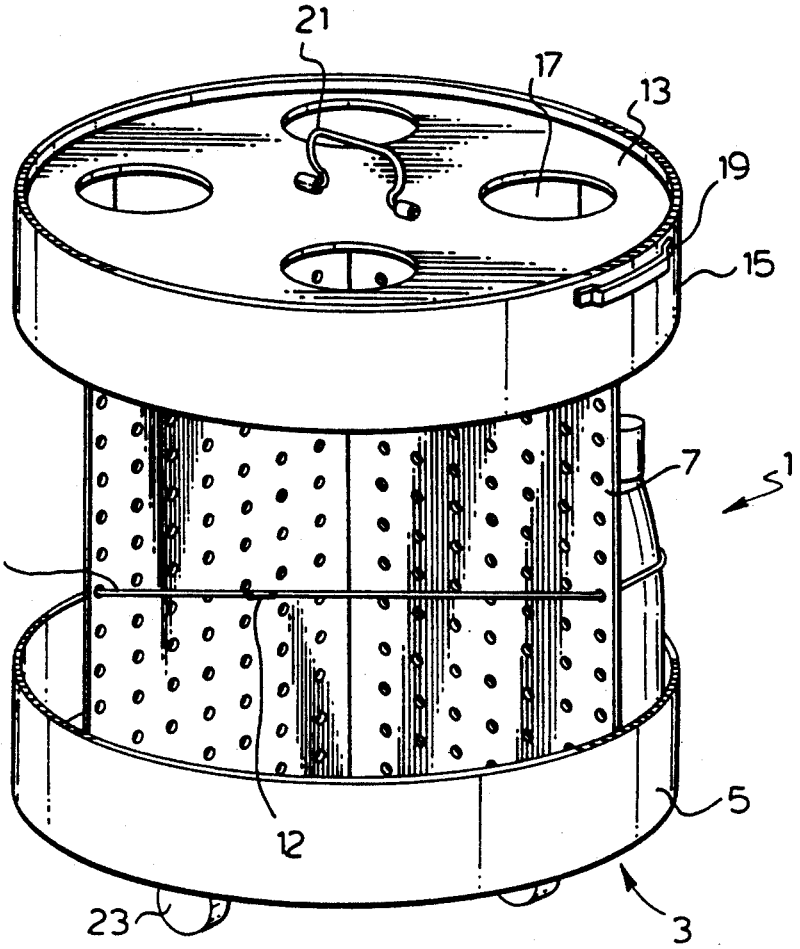
FIG. 1 is a prospective view of a portable storage device according to a preferred embodiment of the present invention.

FIG. 1 shows a portable storage device generally indicated at 1. This device includes a top handle 21 for carrying the device as well as bottom rollers 23 to allow the device to be rolled from place to place.

Figure 2:
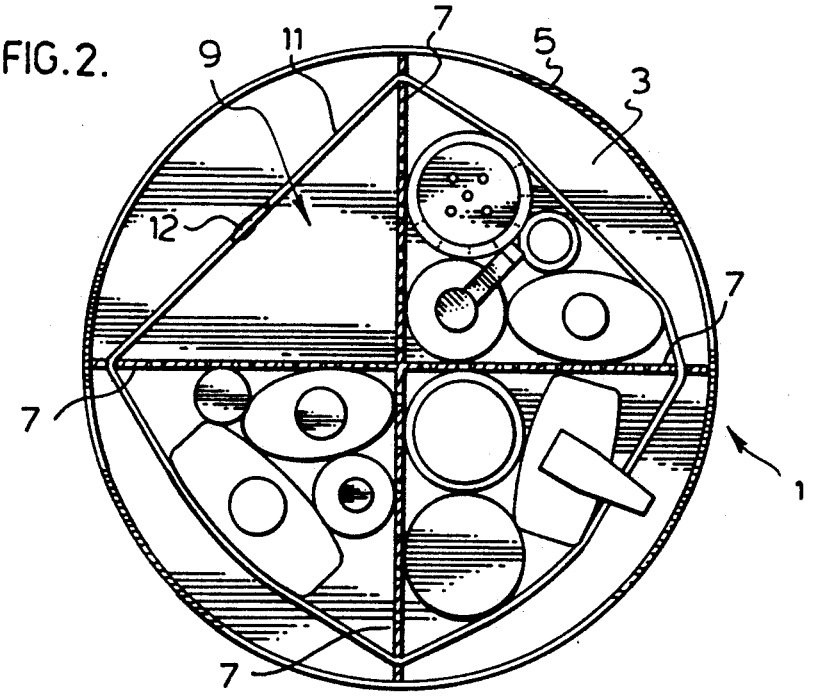
FIG. 2 is a top view of the device of FIG. 1 with the top removed.

The storage device includes a circular base 3 with a short upstanding peripheral wall 5 surrounding the base. Provided interiorly of wall 5 are a plurality of upright panels 7. These panels as best seen in FIG. 2 divide the base into 4 equal sectors generally indicated at 9. Each of these sectors comprises a storage surface defined between wall 5 and adjacent panels 7.

In the particular arrangement shown, the panels all meet centrally of the storage device so that each sector is of an identical shape and size. However, as will be appreciated, the panels can be set up differently to vary the shape and size of each sector. Furthermore, the base need not be round, and different types of supporting panels which are effectively located rearwardly or inwardly can be used.

Regardless of the actual shape of the storage device, it will always have a much shorter forward wall with much taller interior panels or partitions. This allows front access to the storage surface on the base of the device. The articles stored in the device cannot tip backwards because of the tall rearwardly located panels but they could tip forwardly out over the shorter front wall. Accordingly, an elasticized support 11 is additionally provided across adjacent panels at a height elevated to the front wall above the storage surface. This elasticized support still allows easy access to the storage surface while providing a means for trapping a taller article such as the bottles shown in the drawings against tipping outwardly over the front wall. The front wall itself prevents the bottles from sliding forwardly at their lower ends out of the elasticized support.

As will be appreciated, shorter articles more approximating the height of the front wall, do not need to be engaged by the elasticized support since they are trapped on the storage surface by the wall itself.

As best seen in FIG. 2 of the drawings, elasticized support 11 when in its relaxed condition, lies well within the confines of the front peripheral wall 5. Support 11 can however, be stretched outwardly so that the storage area above surface 9 can be completely filled. If on the other hand one does not wish to completely fill the storage area, the elasticized support is still effective in securing any articles within the storage area.

Figure 3:
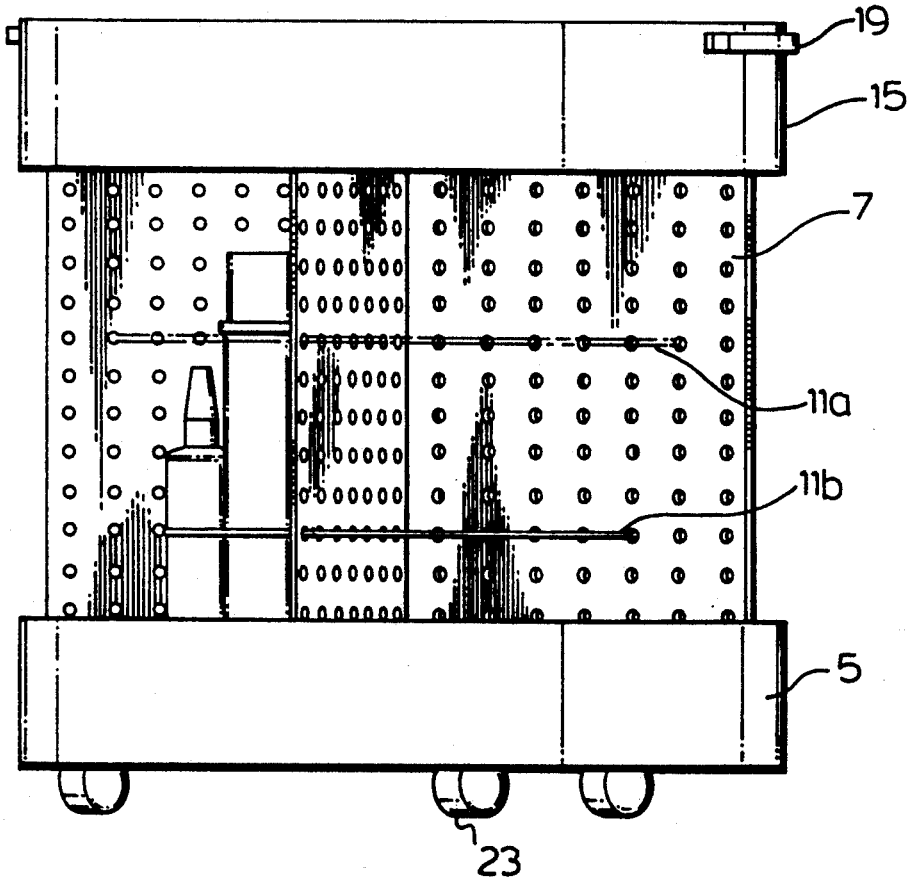
FIG. 3 is a side view of the device of FIG. 1.

As can be clearly seen in FIGS. 1 and 3 of the drawings, each of the panels 7 includes a series of openings spaced both vertically and horizontally from one another. In the particular arrangement shown, elasticized support 11 comprises a single elastic cord having a releasable end connection 12 which allows the releasable inter-fitting of the elasticized support through specific desired openings in all of the panels. This particular arrangement of a releasable elasticized support, in combination with the different openings in the panels, allows different height settings of the support as desired by the end user. It also allows the elasticized support to be set up at different spans across adjacent panels. For example, in one storage area, the support may be set up well inside of the front peripheral wall 5 while in the next storage area, the elasticized support may be set up as far as possible to the outside of the panels much closer to the front wall. The height and the span of the elasticized support at a particular storage sector, can be set according to the specific articles to be stored in that sector.

Another set up for the storage device as seen in FIG. 3 includes a pair of elasticized support **11*a* and 11*b*. As shown, supports 11*a* is set higher and at a wider span than support 11*b***.

As will be appreciated, other positions and numbers of elasticized supports can also be used on the device. Furthermore, the support itself need not have a one piece construction as shown, but rather could be in the form of individual shorter elasticized members one at each storage area or sector. This type of shorter individual support member would include means at each of its ends, such as small hooks of the like which would releasably secure to the panels at opposite sides of the storage area.

To add further to its storage capacity, device 1 is provided with a top wall 14 which in this particular arrangement corresponds in shape and size to the bottom wall 3. The top wall is bordered by a downwardly depending skirt or wall 15 which matches the lower wall 5. Walls 5 and 15 are maintained at a substantial separation from one another to maintain a forward opening to each of the storage areas on the device.

A plurality of small pockets 21 are provided in the top wall. Each of these pockets has a cup-like interior for receiving much smaller items such as, tacks, pins, etc. which can be stored within the pockets.

When needed, the storage device, with all of its neatly organized contents, can be taken from area to area either by lifting it or rolling it. The required cleaners are removed and then replaced in the device in a neat and organized fashion. Once the cleaning has been completed, the storage device is put away as a single unit. It therefore, eliminates the need to have to individually gather and then return all of the items stored in the device.

Although various different preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. An article storage device comprising a base, a top, a plurality of upright panels at divergent angles from one another between said base and said top, each panel being provided with a series of openings located at different positions on each panel, and a single elasticized support fitted through one of the openings in each panel and diagonally traversing all of said panels, said elasticized support having opposite ends connected to one another by a releasable connection allowing refitting of said support in a different one of the openings in each panel for different positionings of said elasticized support on said storage device.

2. An article storage device as claimed in claim 1 including bottom rollers on said device.

3. An article storage device as claimed in claim 1 including storage pockets in said top.

* * * * *